US007254352B2

(12) United States Patent
Lee

(10) Patent No.: US 7,254,352 B2
(45) Date of Patent: Aug. 7, 2007

(54) TEMPERATURE CONTROL METHOD FOR USE IN A FUSING DEVICE OF AN IMAGE FORMING APPARATUS HAVING A FUSING ROLLER AND A HEATER HEATING THE FUSING ROLLER AND IMAGE FORMING APPARATUS USING THE SAME

(75) Inventor: Beom-ro Lee, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/732,249

(22) Filed: Dec. 11, 2003

(65) Prior Publication Data

US 2004/0131375 A1 Jul. 8, 2004

(30) Foreign Application Priority Data

Jan. 7, 2003 (KR) ..... 10-2003-0000895

(51) Int. Cl.
*G03G 15/20* (2006.01)

(52) U.S. Cl. ..... 399/69; 399/70

(58) Field of Classification Search ..... 399/69, 399/70; 219/216

See application file for complete search history.

(56) References Cited

U.S. PATENT DOCUMENTS 5,243,393 A * 9/1993 Menjo ..... 399/325
5,321,479 A * 6/1994 Yoshida et al. ..... 399/70
5,426,494 A * 6/1995 Muto et al. ..... 399/335
5,758,228 A * 5/1998 Hirose et al. ..... 399/70
6,018,140 A * 1/2000 Hirose et al. ..... 219/216
6,185,388 B1 * 2/2001 Yamamoto ..... 399/69
2001/0013943 A1 * 8/2001 Hashimoto et al. ..... 358/1.13

FOREIGN PATENT DOCUMENTS

JP 06027854 A * 2/1994
JP 2002-091225 3/2002

* cited by examiner

*Primary Examiner*—Quana Grainger
(74) *Attorney, Agent, or Firm*—Staas & Halsey LLP

(57) ABSTRACT

A temperature control method for use in a fusing device of image forming apparatus having a fusing roller and a heater heating the fusing roller, including: sensing a surface temperature T of the fusing roller at one of when the image forming apparatus is turned on, when the image forming apparatus begins a normal operation from a power saving operation, and when a cover of the image forming apparatus is closed after being opened; comparing the sensed surface temperature T of the fusing roller with a set temperature; driving the heater until the surface temperature T reaches a first target temperature $Tt_1$ when the sensed surface temperature T is below the set temperature; and driving the heater until the surface temperature T reaches a second target temperature $Tt_2$ when the sensed surface temperature T is over the set temperature.

23 Claims, 9 Drawing Sheets

TEMPERATURE CONTROL METHOD FOR USE IN A FUSING DEVICE OF AN IMAGE FORMING APPARATUS HAVING A FUSING ROLLER AND A HEATER HEATING THE FUSING ROLLER AND IMAGE FORMING APPARATUS USING THE SAME

CROSS-REFERENCE TO RELATED APPLICATIONS

This application claims the benefit of Korean Application No. 2003-895, filed Jan. 7, 2004, in the Korean Intellectual Property Office, the disclosure of which is incorporated herein by reference.

BACKGROUND OF THE INVENTION

1. Field of the Invention

The present invention relates to fusing devices of image forming apparatus such as a laser beam printer, a multi-function machine, a photocopier, and the like, and more particularly, to a method of temperature control in a fusing device of an image forming apparatus by optimizing a power supply to a heater that heats a fusing roller of the fusing device and minimizing fluctuation in surface temperature of the fusing roller.

2. Description of the Related Art

Generally, an image forming apparatus such as a photocopier, a laser beam printer and the like, prints a desired image on a recording medium such as, a sheet of printing paper, by a series of image forming processes. The image forming processes include electrically charging a surface of a photosensitive drum by rotating an electrostatic charging roller disposed adjacent to the photosensitive drum, exposing the surface of the photosensitive drum to a laser beam projected from a laser scanning unit (LSU) to form an electrostatic latent image on the surface of the photosensitive drum, developing the electrostatic latent image formed on the surface of the photosensitive drum to a toner image of a powdery state (i.e. a powdery visible image) by supplying a toner to the surface of the photosensitive drum, transferring the toner image formed on the surface of the photosensitive drum onto the sheet of printing paper by passing the sheet between the photosensitive drum and a transfer roller which are in contact with each other under a pressure, by supplying a transfer voltage to the transfer roller and the photosensitive drum, and fusing the powdery toner image onto the sheet of printing paper by heating the sheet of printing paper with the toner image transferred thereon through a fusing device including a fusing roller.

Generally, in the process of fusing the toner image, a halogen lamp is employed as a heating source of the fusing device. The halogen lamp is disposed inside the fusing roller and/or a fusing backup roller to radiantly heat a surface of the fusing roller and/or the fusing backup roller to a temperature.

FIG. 1 schematically shows a conventional fusing device 10 of a conventional electrophotographic image forming apparatus.

The fusing device 10 includes a cylinder-shaped fusing roller 11 that has a non-stick coating layer of, for example, TEFLON® on a surface thereon, and a halogen lamp 12 disposed in an inner center thereof. The arrangement of the fusing roller 11 and the halogen lamp 12 is also shown in FIG. 2. The halogen lamp 12 generates heat inside of the fusing roller 11, and the fusing roller 11 is thereby heated by a radiant heat from the halogen lamp 12.

Returning to FIG. 1, disposed under the fusing roller 11 is a fusing backup roller 13. As shown in FIG. 3, the fusing backup roller 13 is resiliently supported by a spring 13*a*, so as to press a sheet of printing paper 14 passing between the fusing roller 11 and the fusing-backup roller 13, toward the fusing roller 11 with a pressure.

Accordingly, while the sheet of printing paper 14 is passing between the fusing roller 11 and the fusing backup roller 13, a toner image 14*a* formed on the sheet of printing paper 14 in the powdery state is subjected to a pressure and a heat. As a result, the toner image 14*a* is fused and fixed onto the sheet of printing paper 14 by the pressure and the heat imposed thereto through the fusing roller 11 and the fusing-backup roller 13.

Returning to FIG. 1, installed at a side of the fusing roller 11 are a thermistor 15, a thermostat 16 and a power switching part 19 such as a thyristor. The thermistor 15 is for detecting or sensing a surface temperature of the fusing roller 11 in an electric signal form, the thermostat 16 is for interrupting an electric power supply to the halogen lamp 12 when the surface temperature of the fusing roller 11 exceeds a given threshold, and the power switching part 19 is for switching a power supply of an AC power source 18 to the halogen lamp 12 according to a signal from a controller 20.

The thermistor 15 senses the surface temperature of the fusing roller 11, and transmits the sensed temperature to the controller 20. The controller 20 compares the sensed temperature with a set temperature, and regulates the power supply to the halogen lamp 12 through the power switching part 19, thereby maintaining the surface temperature of the fusing roller 11 in a print temperature suitable to fuse the toner image 14*a* and to fix it onto the sheet of printing paper 14.

The controller 20 usually controls the surface temperature of the fusing roller 11 by a temperature control process that includes an initial heating step of heating the surface temperature of the fusing roller 11 to a print standby temperature, a print standby step of maintaining the surface temperature of the fusing roller 11 at the print standby temperature and waiting a print command, and a printing step of maintaining the surface temperature of the fusing roller 11 higher than the print standby temperature to offset a loss in heat during the fusing operation of fusing the toner image.

At each of the operations of the temperature control process, the controller 20 controls the power supply to the halogen lamp 12, by comparing the sensed surface temperature of the fusing roller 11 with the set temperature and then turning on the halogen lamp 12 through the power switching part 19 when the detected temperature is below the set temperature and turning off the halogen lamp 12 when the detected temperature is over the set temperature, and thereby the surface temperature of the fusing roller 11 is maintained within a given range.

Also, the thermostat 16 functions as an overheating prevention means to protect the fusing roller 11 and its neighboring components, in case that the thermistor 15 and the controller 20 fail to regulate the surface temperature of the fusing roller 11.

However, the aforementioned fusing device is not without disadvantages. For example, in the conventional fusing device 10, since the halogen lamp 12 is turned on or off, regardless of a state or condition at each of the steps of the temperature control process for regulating the surface temperature of the fusing roller 11 in the print temperature, the electric power may not be efficiently supplied to the halogen lamp 12, thereby increasing power consumption and fluctuation in the surface temperature of the fusing roller 11 may be large.

When the fluctuation in the surface temperature of the fusing roller 11 is enlarged, the print temperature is unstably controlled, and thereby irregularly fusing the toner image onto the sheet of printing paper.

SUMMARY OF THE INVENTION

The present invention has been developed in order to solve the above and/or other problems in the related art. Accordingly, it is an aspect of the present invention to provide a temperature control method for use in a fusing device of image forming apparatus, which is capable of stably fusing a toner image to fix it onto a recording medium such as a sheet of printing paper, by minimizing a fluctuation in a surface temperature of a fusing roller to stably maintain the surface temperature of the fusing roller.

It is another aspect of the present invention to provide a temperature control method for use in a fusing device of image forming apparatus, which is capable of optimizing a power supply to a heater that heats a fusing roller of the fusing device, thereby minimizing an amount of electric power which is supplied to the heater, as well as stably supplying it thereto.

Additional aspects and/or advantages of the invention will be set forth in part in the description which follows and, in part, will be obvious from the description, or may be learned by practice of the invention.

According to an embodiment of the present invention, there is provided a temperature control method for use in a fusing device of image forming apparatus having a fusing roller and a heater heating the fusing roller, including: sensing a surface temperature T of the fusing roller at one of when the image forming apparatus is turned on, when the image forming apparatus begins a normal operation from a power saving operation, and when a cover of the image forming apparatus is closed after being opened; comparing the sensed surface temperature T of the fusing roller with a set temperature; driving the heater until the surface temperature T reaches a first target temperature $Tt_1$ when the sensed surface temperature T is below the set temperature; and driving the heater until the surface temperature T reaches a second target temperature $Tt_2$ when the sensed surface temperature T is over the set temperature.

The operation of driving the heater until the surface temperature T reaches the second target temperature $Tt_2$ may include driving the heater for a first driving time or on-time calculated by the following formula every first control period $T_1$ where:

$$\text{first on-time (ms)}=T_1\times(\alpha_1\times(T-Tt_2)+\beta_1)/100,$$

and where $\alpha 1$ is a first given proportional factor, and $\beta_1$ is a first offset value set according to the second target temperature $Tt_2$.

Here, the first offset value $\beta_1$ is set by a value, by which the surface temperature T of the fusing roller is maintainable at the second target temperature $Tt_2$when the heater is driven only for an on-time calculated by the formula of $T_1\times\beta_1/100$ every first control period $T_1$ after the surface temperature of the fusing roller has reached the second target temperature $Tt_2$, or a value less than the value.

The method may further include a standing by operation by controlling the driving of the heater to maintain the surface temperature T at a third target temperature $Tt_3$ after the sensing, comparing and driving operations.

The print standby operation may include driving the heater for a second on-time calculated by the following formula every second control period $T_2$ to maintain the surface temperature T at a third target temperature $Tt_3$ where:

$$\text{second on-time (ms)}=T_2\times(\alpha_2\times(T-Tt_3)+\beta_2)/100,$$

and where $\alpha_2$ is a second given proportional factor, and $\beta_2$ is a second offset value set according to the third target temperature $Tt_3$.

At this time, the third target temperature $Tt_3$ is the print standby temperature described above, and is settable by the same temperature as the second target temperature $Tt_2$.

The second proportional factor $\alpha_2$ may be determined by a rising slope in the surface temperature T of the fusing roller and the third target temperature $Tt_3$. Also, the second offset value $\beta_2$ may be one of a value V by which the surface temperature T of the fusing roller is maintained at the third target temperature $Tt_3$ when the heater is driven only for an on-time calculated by the following formula every second control period $T_2$, and a value less than the value V where:

$$\text{on-time}=T_2\times\beta_2/100.$$

The method may further include printing by controlling the driving of the heater to maintain the surface temperature T at a fifth target temperature $Tt_5$ when a print command is input in the standing by operation.

The printing may include driving the heater until the surface temperature T reaches a fourth target temperature Tt4; and controlling the driving of the heater to maintain the surface temperature T at the fifth target temperature Tt5.

The operation of controlling the driving of the heater to maintain the surface temperature T at the fifth target temperature $Tt_5$ may include driving the heater when a surface temperature T of the fusing roller sensed every third control period $T_3$ is below the fifth target temperature $Tt_5$; and stopping the driving of the heater when the surface temperature T of the fusing roller sensed every third control period $T_3$ is over the fifth target temperature $Tt_5$.

During the stopping the driving of the heater, when the surface temperature T of the fusing roller is greater than fifth target temperature $Tt_5$, and the heater is driving and a heater driving time has not lapsed, the heater may be continuously driven until the heater driving time lapses. Also, the fourth target temperature $Tt_4$ may be one of the same temperature as the fifth target temperature $Tt_5$ and a temperature higher than the fifth target temperature $Tt_5$.

The method may further include saving power by carrying out a power saving operation when a print command is not input even though a standby time $T_4$ has lapsed in the standing by operation.

The method of power saving may include: determining whether the print command is input every fifth control period $T_5$ after a lapse of the standby time $T_4$; and controlling the driving of the heater to maintain the surface temperature T at a sixth target temperature $Tt_6$ when the print command is not input.

The operation of controlling the driving of the heater to maintain the surface temperature T at the sixth target temperature $Tt_6$ may include driving the heater for a third on-time calculated by the following formula every fourth control period $T_5$ where:

$$\text{third on-time (ms)}=T5\times(\alpha_3\times(T-Tt_6)+\beta_3)/100,$$

and where $\alpha_3$ is a third given proportional factor, and $\beta 3$ is a third offset value set according to the sixth target temperature $Tt_6$.

The sixth target temperature $Tt_6$ is settable by an appropriate temperature below the third target temperature $Tt_3$ that is the print standby temperature.

Also, the third offset value $\beta_3$ is set by one of a value, by which the surface temperature T of the fusing roller can be maintained at the third target temperature $Tt_3$ when the heater is driven only for an on-time calculated by the formula of $T_5 \times \beta_3/100$ every fourth control period $T_5$ after the surface temperature T of the fusing roller has reached the sixth target temperature $Tt_6$, or a value less than the value.

Alternatively, the power saving can be composed of determining whether the print command is input after the lapse of the standby time $T_4$, and stopping the driving of the heater when the print command is not input.

According to another embodiment of the present invention, the fusing roller includes a rubber layer formed in a given thickness on a surface thereof.

A temperature control method of a fusion section of an image forming apparatus, including: raising the surface temperature of a fusion roller to a standby temperature which is close to a printing temperature; maintaining the standby temperature of the surface of the fusion roller after the raising; raising the surface temperature of the fusion roller to a printing temperature when a print command is received during the maintaining; and performing a power saving operation after a standby time has lapsed in the maintaining.

According to another aspect of the present invention, there is provided an image forming apparatus, including: a fusing roller; a heater disposed inside of the fusing roller and which increases a surface temperature of the fusing roller; and a control section including a sensor part which detects the surface temperature of the fusion roller and interrupts a power supply to the heater. The control section controls the surface temperature of a fusing roller by heating the surface according to a different algorithm for each of a warming-up, standing by, printing, and power saving operation of the image forming device so as to minimize surface temperature fluctuation and optimize power controlling a surface temperature of a fusing roller by heating the surface according to a different algorithm for each of a warming-up, standing by, printing, and power saving operation of the image forming device so as to minimize surface temperature fluctuation and optimize power supplied to perform the heating.

According to yet another embodiment of the present invention, there is provided a temperature control method including: initially heating a fusion roller of an image forming apparatus by increasing a surface temperature of the fusing roller to a temperature when the image forming apparatus is turned on; print standing by maintaining the increased surface temperature and waiting for a print command; and printing by increasing the surface temperature to a print temperature and fusing a toner image onto a sheet of printing paper. The initial heating, print standing by, and printing operations are each controlled according to a different temperature control algorithm.

BRIEF DESCRIPTION OF THE DRAWINGS

These and other aspects and advantages of the invention will become apparent and more readily appreciated from the following description of the taken in conjunction with the accompanying drawings in which.

DETAILED DESCRIPTION OF THE PREFERRED EMBODIMENTS

Figure 1:
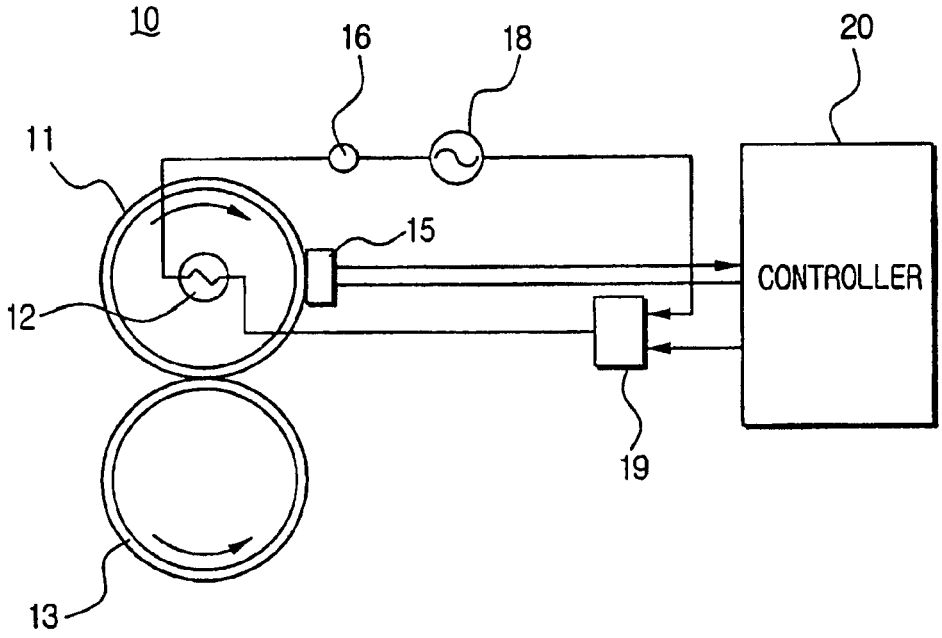
FIG. 1 (PRIOR ART)
FIG. 1 is a schematic perspective view of a fusing device and a controller therefor in a conventional electrophotographic image forming apparatus.

Reference will now be made in detail to embodiments of the present invention, examples of which are illustrated in the accompanying drawings, wherein like reference numerals refer to the like elements throughout. The embodiments are described below in order to explain the present invention by referring to the figures.

Figure 4:
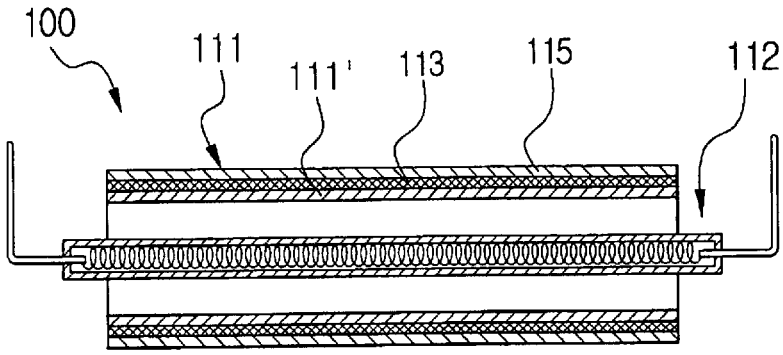
FIG. 4 is a cross-sectional view of a fusing roller and a heater in a fusing device to which a temperature control method according to an embodiment of the present invention is applied.

FIG. 4 schematically shows a part of a fusing device 100 of electrophotographic image forming apparatus, to which a temperature control method according to an embodiment of the present invention is applied.

The fusing device 100 includes a cylinder-shaped fusing roller 111 having a rubber layer on which a non-stick coating film 115, such as, by way of non-limiting example, TEFLON®, is coated, a fusing-backup roller (not shown) disposed under the fusing roller 111 to press the fusing roller 111 with a pressure, a heater 112, such as, by way of non-limiting example, a halogen lamp, is disposed in an inner center of the fusing roller 111 to generate a fusing heat for fusing a toner image and fixing it onto a sheet of printing paper inside the fusing roller 111, and a sensor part having a thermistor (not shown) and a thermostat (not shown) installed with respect to the fusing roller 111 respectively to detect a surface temperature of the fusing roller 111 and to interrupt an electric power supply to the heater 112 when the surface temperature of the fusing roller 111 exceeds a given threshold. The fusing device 100 also includes a controller (not shown) controlling an AC power supply to the heater 112 according to the surface temperature of the fusing roller 111, thereby to regulate an initial fusing roller-warming-up operation of heating the surface temperature of the fusing roller 111 to a print standby temperature, a standing by operation of maintaining the surface temperature of the fusing roller 111 at the print standby temperature and waiting a print command, a print operation of maintaining the surface temperature of the fusing roller 111 at a temperature higher than the print standby temperature to offset a loss in heat during a fusing operation, etc.

Figure 2:
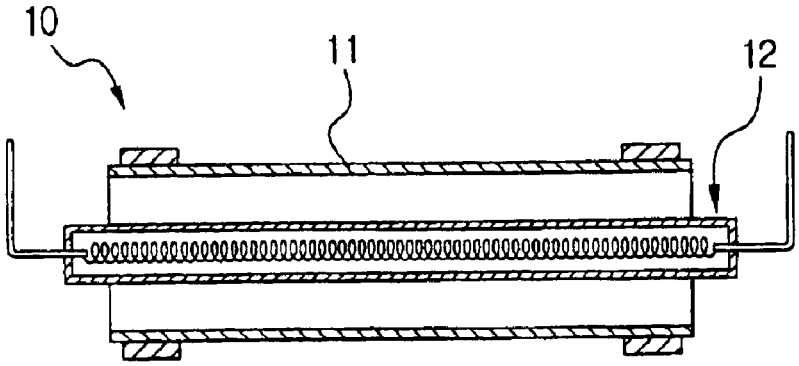
FIG.2 (PRIOR ART)
FIG. 2 is a schematic cross-sectional view of a fusing roller and a heater of the fusing device shown of FIG. 1.
Figure 3:
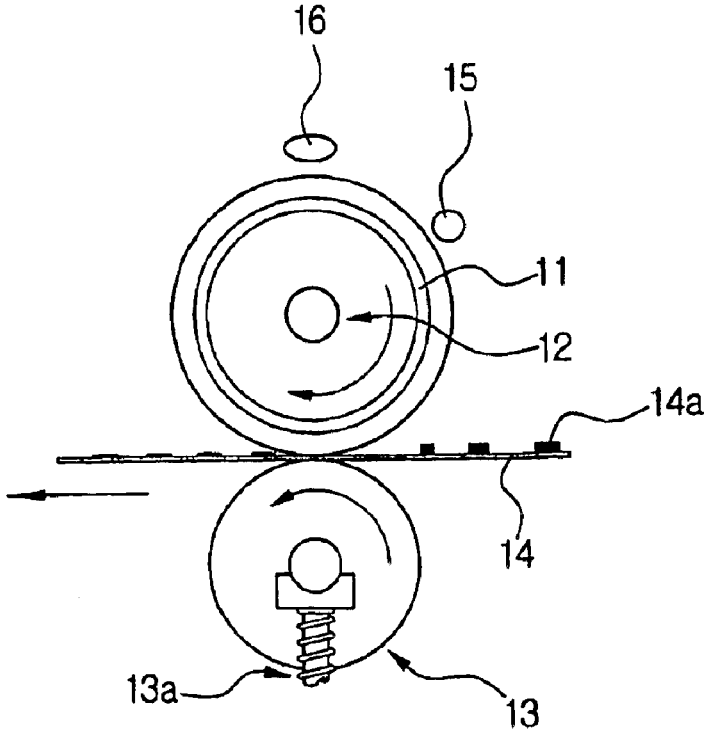
FIG.3 (PRIOR ART)
FIG. 3 is a schematic side elevation view of the fusing device shown of FIG. 1.

A description of the construction of the above elements except for the fusing roller 111 and the controller will be omitted here, as they are identical to those described above with reference to FIGS. 1, 2 and 3.

To supply a sufficient fusing heat to the toner image and the sheet of printing paper and increase a time on which the sheet of printing paper stays, the fusing roller 111 is formed of a cylinder-shaped aluminum roller having the rubber layer 113 which is TEFLON® coated or tubed on a surface thereof. Alternatively, the fusing roller 111 can use a cylinder-shaped aluminum roller having a coating layer coated or tubed with TEFLON® on a surface thereof, as the fusing device 10 shown in FIG. 2.

In the present embodiment, the fusing roller 111 has an aluminum cylinder 111' formed in a thickness of about 1.5 mm, a rubber layer 113 formed in a thickness of about 1.5 mm on the aluminum cylinder, and a TEFLON® coating film 115 formed of a thickness of about 20–30 μm on the rubber layer 113. Also, the heater 112 uses 800 W at 220V. However, it is to be understood that other materials, thicknesses, and/or amounts are possible.

The temperature control method according to the present embodiment controls an optimum temperature by using a different algorithm for each of the operations such as the initial fusing roller-warming-up operation, the print standby operation, the printing operation, etc., thereby minimizing fluctuations in the surface temperature of the fusing roller and optimizing a power supply to the heater.

Hereinafter, descriptions will be made of operations about the temperature control method for use in the fusing device 100 of image forming apparatus according to an embodiment of the present invention with reference to FIG. 5 through FIG. 11.

Figure 5:
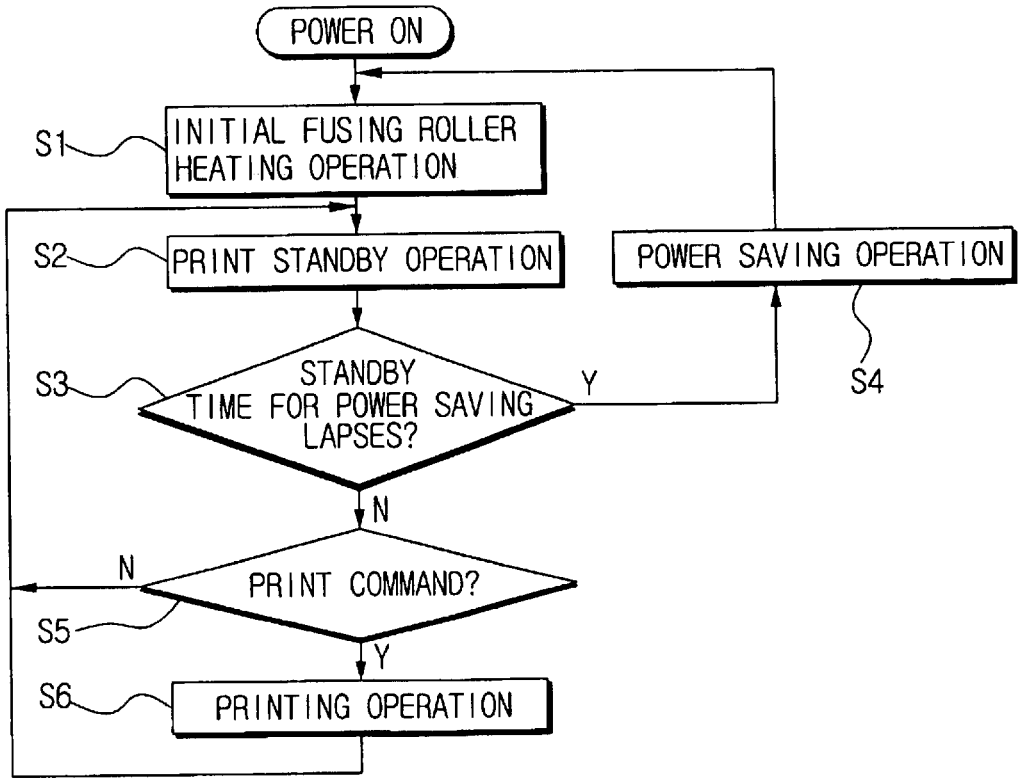
FIG. 5 is a flowchart illustrating a process of the temperature control method in accordance with an embodiment of the present invention.

First, when the image forming apparatus is turned on, as shown in FIG. 5, the controller carries out an initial fusing roller-warming-up operation (S1) to allow the fusing roller 111 to proceed with a fusing operation at any moment. As a result, a surface temperature T of the fusing roller 111 which is maintained at room temperature is increased to a third target temperature $Tt_3$ (i.e., a print standby temperature, for example 165° C.) close to a fifth target temperature $Tt_5$ (i.e., a print temperature, for example 180° C.).

Figure 6:
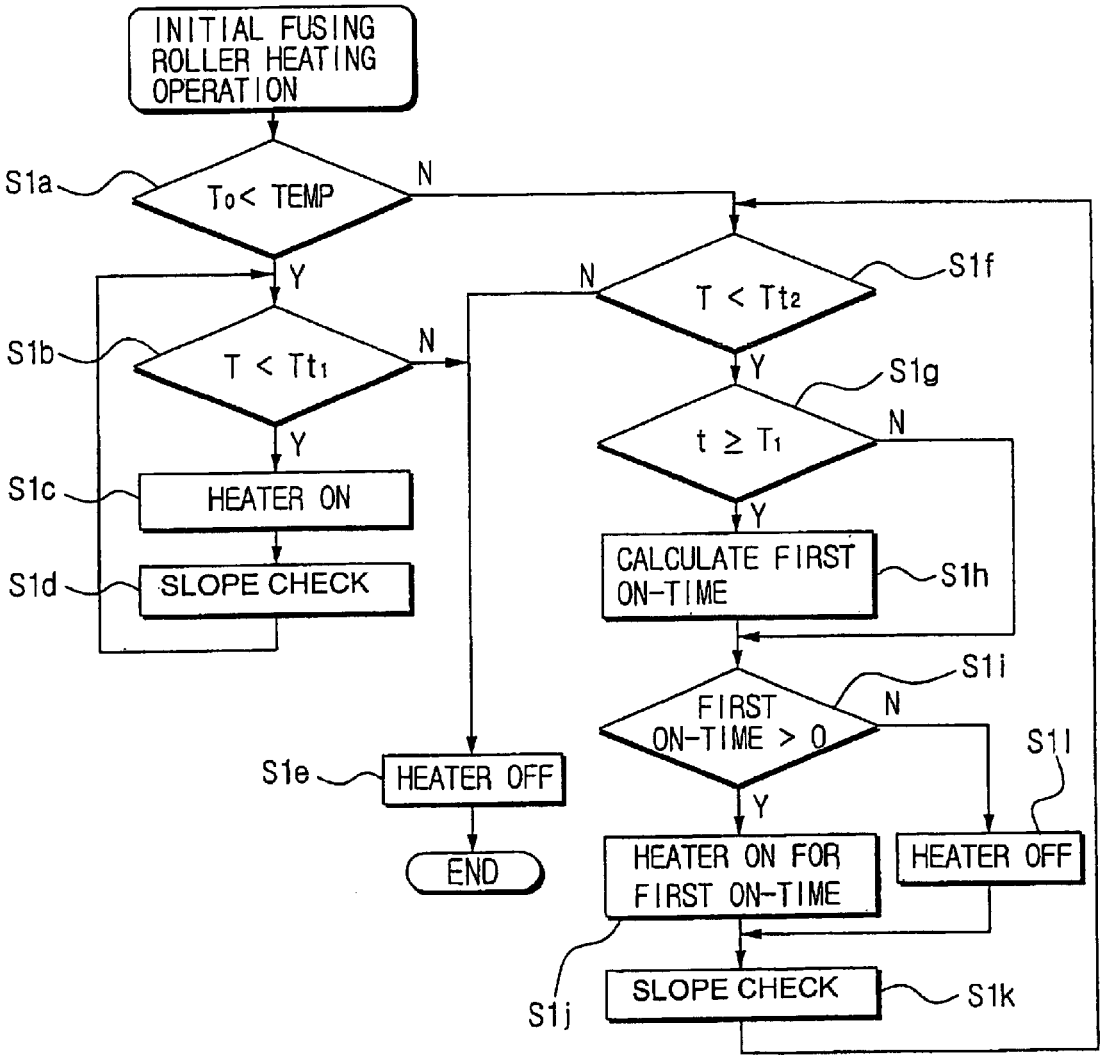
FIG. 6 is a flowchart illustrating a process of an initial fusing roller-warming-up operation of the temperature control method in accordance with an embodiment of the present invention.

More specifically, as shown in FIG. 6, during a process of the initial fusing roller-warming-up operation (S1), the sensor part detects or senses an initial surface temperature $T_0$ of the fusing roller 111, and sends a signal corresponding to the sensed initial surface temperature $T_0$ to the controller, and then the controller compares the initial surface temperature $T_0$ obtained from the received signal with a set temperature Temp, for example 135° C. (S1*a*).

As a result of the comparison, when the sensed initial surface temperature $T_0$ is below the set temperature Temp, the controller continues to drive the heater 112 so as to increase the surface temperature T of the fusing roller 111 to a first target temperature $Tt_1$ in a short time (S1*c*), while determining whether the surface temperature T of the fusing roller 111 has reached the first target temperature $Tt_1$ (S1*b*). At this time, as shown in FIG. 11, the operation S1*c* carries out a phase control for a given initial time to minimize a fluctuation in voltage when an electric power is first supplied to the heater 112.

Subsequently, the controller checks a change slope in the surface temperature T of the fusing roller 111 to determine whether the sensor part is normally operated (S1*d*).

After that, when the surface temperature T reaches the first target temperature $Tt_1$, (i.e. when at operation S1*b*), the controller determines whether the surface temperature T has reached the first target temperature $Tt_1$, and the controller interrupts the electric power supply to the heater 112 to stop the driving of the heater 112 (S1*e*).

Figure 11:
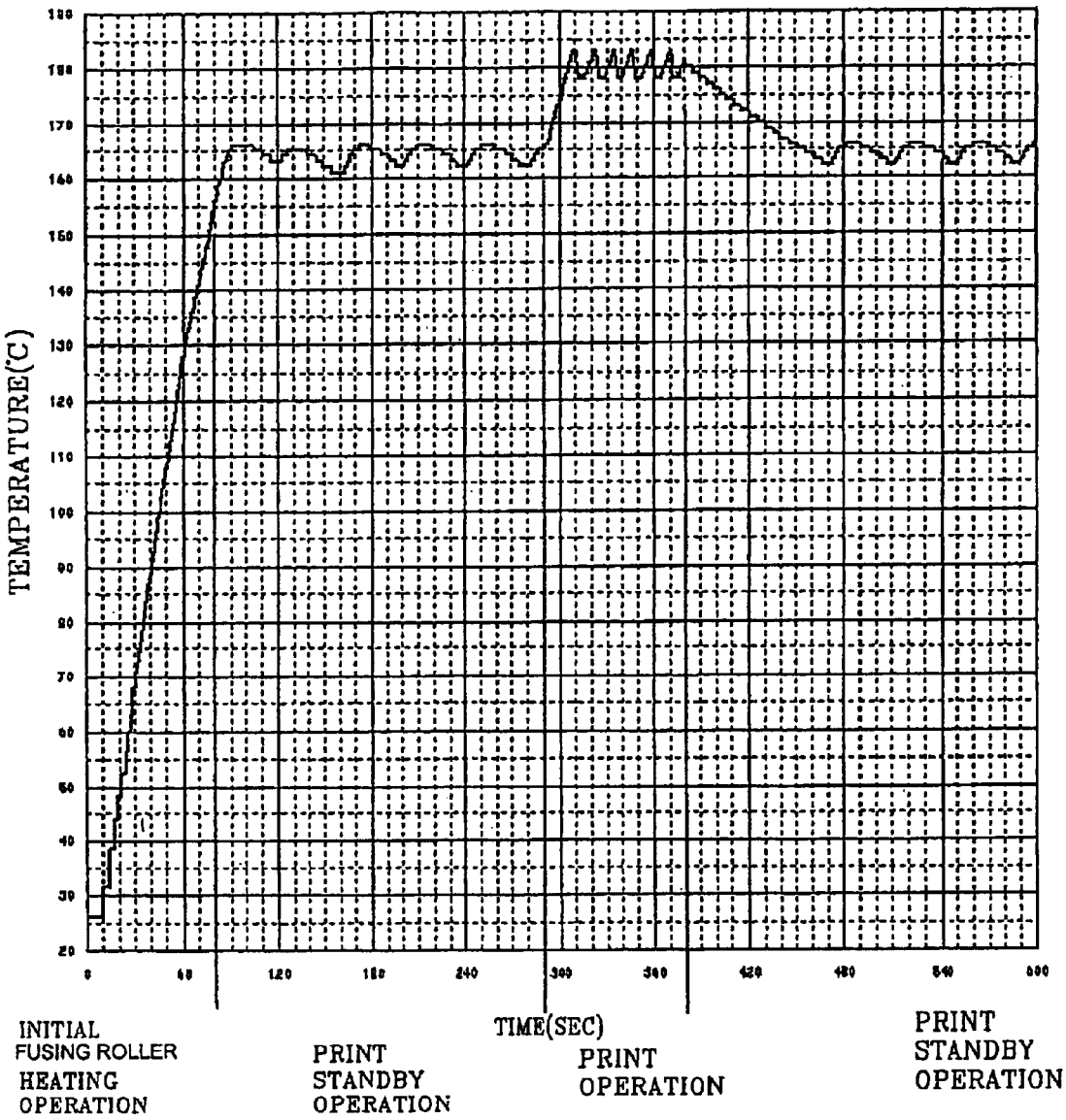
FIG. 11 is a graph illustrating surface temperatures of the fusing roller controlled according to the temperature control method in accordance with an embodiment of the present invention.

At this time, as shown in FIG. 11, the first target temperature $Tt_1$ is set at 155° C. The reason why the first target temperature $Tt_1$ is not set at 165° C. that is the print standby temperature $Tt_3$, but 155° C. is that if the heater is continuously driven at 165° C., the surface temperature T of the fusing roller 111 overshoots 165° C. To prevent such overshooting, the heater is driven at 155° C. (lower than 165° C.), and thereby the surface temperature T of the fusing roller 111 is increased to 165° C. by a heat capacity hitherto supplied.

Of course, if required, to supply a sufficient heat capacity to the fusing roller 111, the heater 112 will be continuously operated at 165° C., so that the surface temperature T of the fusing roller 111 overshoots 165° C.

On the other hand, as a result of the comparison at the operation S1*a*, when the sensed initial surface temperature $T_0$ is over the set temperature Temp, like when the image forming apparatus begins a normal operation from a power saving operation to be described later or when a cover of the image forming apparatus is closed after being opened for, by way of non-limiting example, maintenance and repair, if the heater 112 is continuously operated at 165° C. like as in the above operations (S1*b*–S1*d*), the surface temperature T of the fusing roller 111 overshoots the print standby temperature $Tt_3$. Accordingly, at this time, the controller repeatedly carries out the below operations (S1*g*–S1*l*) to calculate a heat capacity required to reach a second target temperature $Tt_2$, for example, 165° C., and then to drive the heater 112 for a required driving or on-time every a first control period $T_1$ until the surface temperature T of the fusing roller 111 reaches the second target temperature $Tt_2$, while determining whether the surface temperature T of the fusing roller 111 has reached the second target temperature $Tt_2$ (S1*f*).

More specifically, after determining whether the first control period $T_1$ has lapsed (S1*g*), the controller calculates a first on-time according to the following formula (1) when the first control period $T_1$ has lapsed (S1*h*):

$$\text{first on-time (ms)} = T_1 \times (\alpha_1 \times (T - Tt_2) + \beta_1)/100 \quad (1)$$

where $\alpha_1$ is a first given proportional factor, and $\beta_1$ is a first offset value set according to the second target temperature $Tt_2$.

Here, the first control period $T_1$, the first proportional factor $\alpha_1$, and the first offset value $\beta_1$ are set by values that yields an optimum first on-time. For example, the first offset value $\beta_1$ is set by a value by which the surface temperature T of the fusing roller 111 is maintainable at the second target temperature $Tt_2$ when the heater is driven only for an on-time calculated by the formula of $T_1 \times \beta_1/100$ every first control period $T_1$ after the surface temperature T of the fusing roller 111 has reached the second target temperature $Tt_2$, or a value less than the value.

Thereafter, the controller determines whether the first on-time still remains (S1*i*), drives the heater 112 (S1*j*) or stops the driving of the heater 112 (S1*l*), and then checks a change slope in the surface temperature T of the fusing roller 111 to determine whether the sensor part is normally operated (S1*k*).

Thus, after repeatedly carrying out operations (S1*g*–S1*l*), the controller blocks the electric power from being supplied to the heater 112 when at operation S1*f*, determining that the surface temperature T has reached the second target temperature $Tt_2$ (S1*e*), and thereby the initial fusing roller-warming-up operation S1 comes to an end.

The second target temperature $Tt_2$ is explained as being set to the third target temperature $Tt_3$, i.e., 165° C. equal to the print standby temperature, but it is settable by a temperature higher than the third target temperature $Tt_3$ to supply a sufficient heat capacity to the fusing roller 111 as described above, or a temperature lower than the third target temperature $Tt_3$ to proceed to the standing by operation more quickly.

Also, it is possible for the first proportional factor $\alpha_1$ and the first offset value $\beta_1$, to use a second proportional factor $\alpha_2$ and a second offset value $\beta_2$ of the print standby operation which will be described, respectively. However, to allow the surface temperature T to reach the second target temperature $Tt_2$ more quickly, the first proportional factor $\alpha_1$ is settable to a higher value.

Of course, the first control period $T_1$ can also use a second control period $T_2$ of the print standby operation, but since the second control period $T_2$ has a large period of 30~40 sec, it uses a value smaller than the second control period $T_2$.

Referring again to FIG. 5, after the initial fusing roller-warming-up operation S1, the controller carries out a print standby operation S2 to maintain the surface temperature T of the fusing roller 111 at the print standby temperature, (i.e., the third target temperature $Tt_3$), and thereby allowing the fusing roller 111 to proceed with the fusing operation at any moment.

Figure 7:
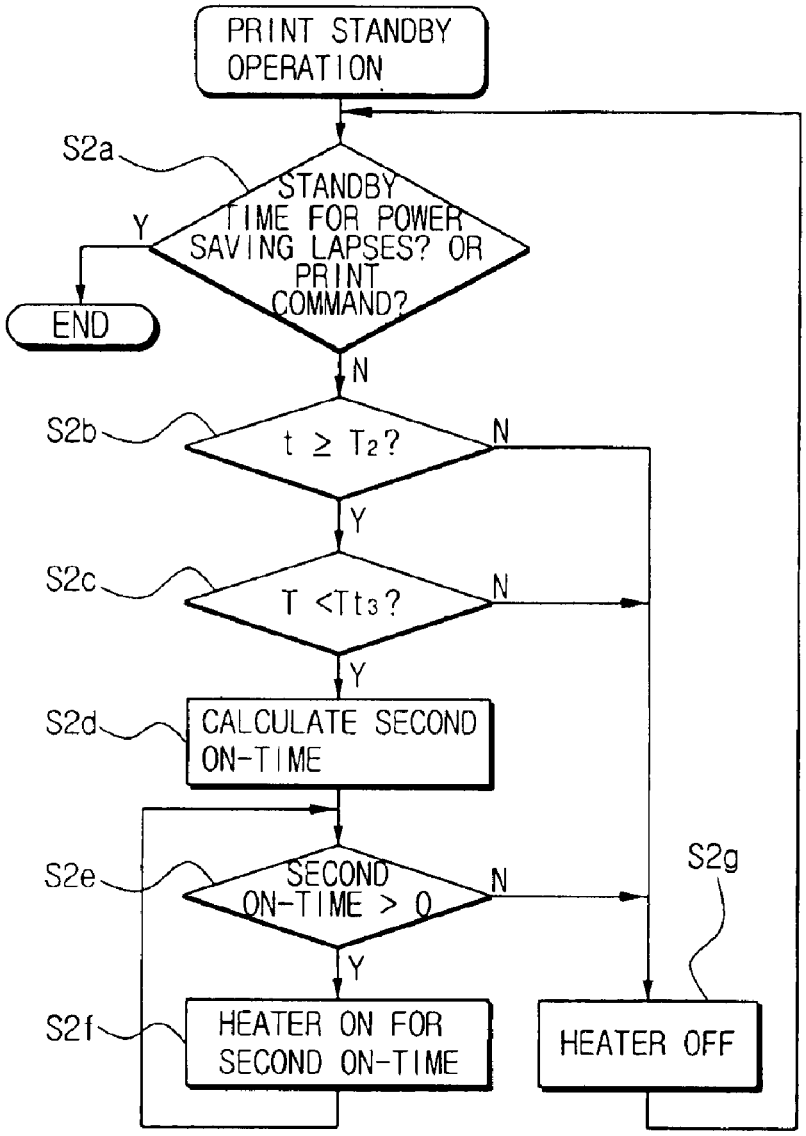
FIG. 7 is a flowchart illustrating a process of a print standby operation of the temperature control method in accordance with an embodiment of the present invention.

That is to say, as shown in FIG. 7 illustrating a process of the print standby operation S2, the controller determines whether a standby time $T_4$ for power saving has lapsed (S3), or whether a print command is input (S5) as shown in FIG. 5 (S2*a*), and when the standby time $T_4$ has not lapsed and the print command is not input, repeatedly carries out the below operations (S2*b*–S2*g*) to calculate a heat capacity required to reach the third target temperature $Tt_3$, i.e. the print standby temperature (165° C.; FIG. 11) and then to drive the heater 112 for a required on-time every second control period $T_2$ until the surface temperature T of the fusing roller 111 reaches the third target temperature $Tt_3$.

More specifically, after determining whether the second control period $T_2$ has lapsed (S2*b*), the controller determines whether the surface temperature T of the fusing roller 111 is over the third target temperature $Tt_3$ when the second control period $T_2$ has lapsed (S2*c*).

As a result of the decision, when the surface temperature T of the fusing roller 111 is below the third target temperature $Tt_3$, the controller calculates a second on-time according to the following formula (2) (S2*d*):

$$\text{second on-time (ms)}=T_2\times(\alpha_2\times(T-Tt_3)+\beta_2)/100 \quad (2)$$

where $\alpha_2$ is a second given proportional factor, and $\beta_2$ is a second offset value set according to the third target temperature $Tt_3$.

At this time, the second proportional factor $\alpha_2$ is determined by a rising slope in the surface temperature T of the fusing roller 111 and the third target temperature $Tt_3$, and the second offset value $\beta_2$ is set by a value by which the surface temperature T of the fusing roller 111 is maintainable at the third target temperature $Tt_3$ when the heater 112 is driven only for an on-time calculated by the formula of $T_2\times\beta_2/100$ every second control period $T_2$ after the surface temperature T of the fusing roller has reached the third target temperature $Tt_3$, or a value less than the value.

Thereafter, the controller determines whether the second on-time still remains (S2*e*), and drives the heater 112 (S2*f*) or stops the driving of the heater 112 (S2*g*) according to the remaining second on-time.

Thus, after repeatedly carrying out operations (S2*b*–S2*g*), the controller ends the print standby operation S2 when at the operation S2*a*, the standby time $T_4$ has lapsed or the print command is input.

At this time, at the operation S2*a*, as shown in FIG. 5, if the print command is input, the controller carries out the print operation S6 to control the driving of the heater 112 so as to maintain the surface temperature T of the fusing roller 111 at a fifth target temperature $Tt_5$, i.e. the print temperature of 180° C. as illustrated in FIG. 11.

Figure 8:
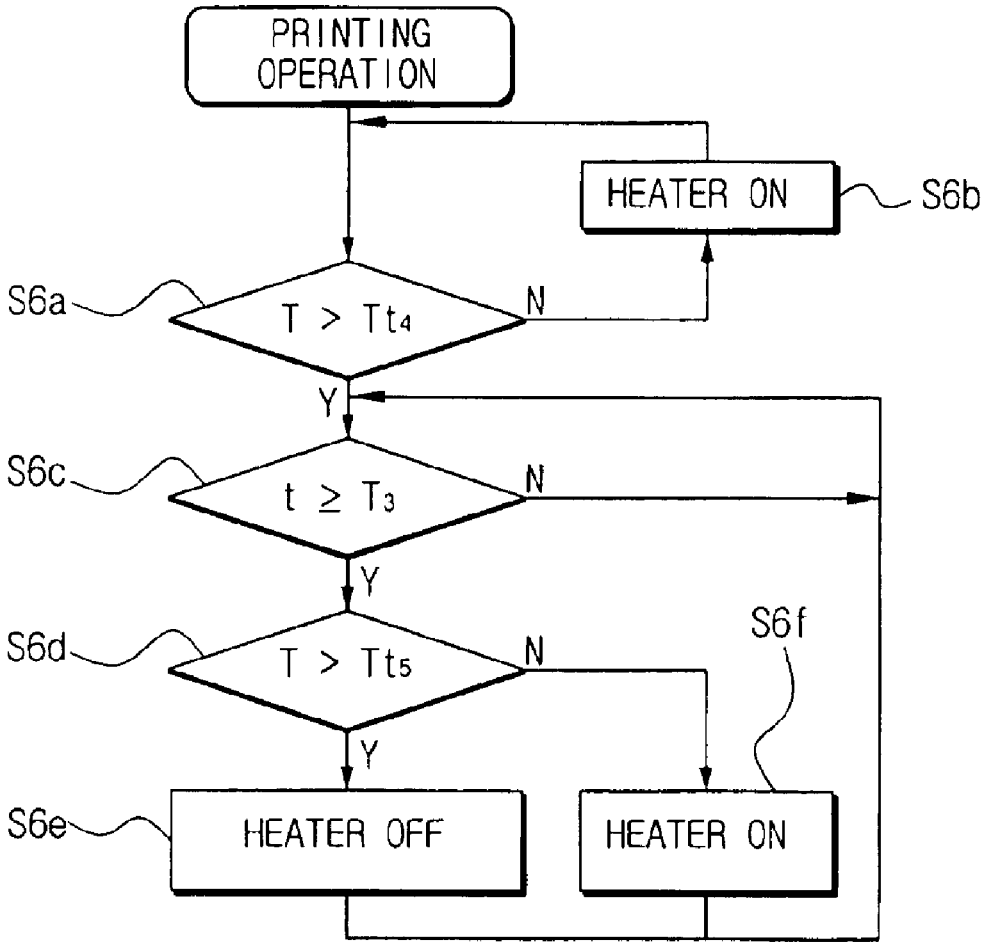
FIG. 8 is a flowchart illustrating a process of a printing operation of the temperature control method in accordance with an embodiment of the present invention.

As shown in FIG. 8 illustrating a process of the print operation S6, at the print operation S6, the controller first determines whether the surface temperature T of the fusing roller 111 has reached a fourth target temperature $Tt_4$, for example an appropriate temperature below 180° C. (S6*a*). As a result of the decision, when the surface temperature T is below the fourth target temperature $Tt_4$, the controller continues to drive the heater 112 (S6*b*), whereas when the surface temperature T is over the fourth target temperature $Tt_4$, repeatedly carries out the below operations (S6*c*–S6*f*) every a third control period $T_3$, for example a period of time at which the sheet of printing paper stays on the fusing roller 111 or 1/n of printing time, in order to maintain the surface temperature T at the fifth target temperature $Tt_5$.

That is to say, after determining whether a time corresponding to the third control period $T_3$ has lapsed (S6*c*), the controller determines whether the surface temperature T of the fusing roller 111 is over the fifth target temperature $Tt_5$ when the time corresponding to the third control period $T_3$ has lapsed (S6*d*).

As a result of the decision, when the surface temperature T of the fusing roller 111 is over the fifth target temperature $Tt_5$, the controller stops the driving of the heater 112 (S6*e*), and when the surface temperature T of the fusing roller 111 is below the fifth target temperature $Tt_5$, it continues to drive the heater 112 (S6*f*).

At the operation S6*e*, when the surface temperature T of the fusing roller is over the fifth target temperature $Tt_5$, but the heater 112 is driving and the time corresponding to the third control period $T_3$ does not lapse, the heater is continuously driven until the time corresponding to the third control period $T_3$ lapses.

These operations (S6*c*–S6*f*) are repeated until a printing operation comes to an end.

Thus, when the printing operation is ended, the controller again carries out the print standby operation S2 to maintain the surface temperature T of the fusing roller 111 at the third target temperature $Tt_3$, i.e., the print standby temperature.

At this time, after the printing operation is ended, if the heater 112 is driving and there is no print command for a next sheet of printing paper, the controller stops the driving of the heater 112, since if the heater 112 is continuously driven, the surface temperature T of the fusing roller 111 is overshot for a time corresponding to the beginning of the second control period $T_2$ that starts to regulate it in the print standby temperature $Tt_3$.

On the other hand, at operation S2*a* of the print standby operation S2, as shown in FIG. 5, when the print command is not input even though the standby time $T_4$ for power saving has lapsed, the controller carries out the power saving operation S4.

Figure 9:
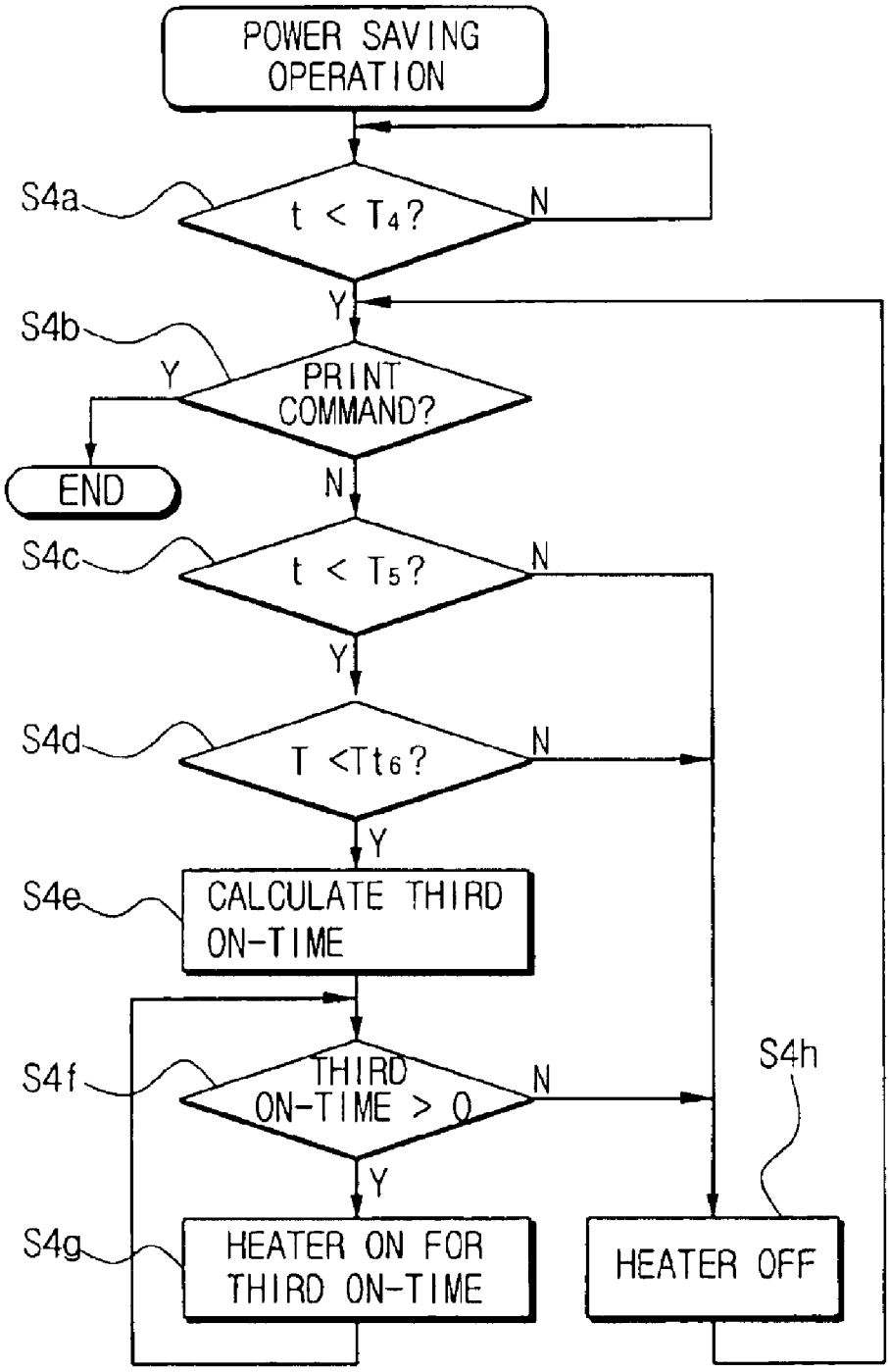
FIG. 9 is a flowchart illustrating an example of a process of a power saving operation of the temperature control method in accordance with an embodiment of the present invention.

More specifically, as shown in FIG. 9 illustrating an example of a process of the power saving operation S4, the controller determines whether the standby time $T_4$ has lapsed (S4*a*), and when the standby time $T_4$ has lapsed, determines whether the print command is input (S4*b*).

As a result of the decision at the operation S4*b*, when the print command is not input, the controller repeatedly carries out the below operations (S4*c*–S4*h*) to calculate a heat capacity required to maintain the surface temperature T of the fusing roller 111 at a sixth target temperature $Tt_6$, i.e., a power saving temperature (for example a temperature below 165° C.) and then to drive the heater 112 for a required driving or on-time every a fourth control period $T_5$.

That is to say, after determining whether the fourth control period $T_5$ has lapsed (S4*c*), the controller determines whether the surface temperature T of the fusing roller 111 is over the sixth target temperature $Tt_6$ when the fourth control period $T_5$ has lapsed (S4*d*).

As a result of the decision, when the surface temperature T of the fusing roller 111 is below the sixth target temperature $Tt_6$, the controller calculates a third on-time according to the following formula (3) (S4*e*):

$$\text{third on-time (ms)}=T_5\times\{\alpha_3\times(T-Tt_6)+\beta_3\}/100 \quad (3)$$

where $\alpha_3$ is a third given proportional factor and $\beta_3$ is a third offset value set according to the sixth target temperature $Tt_6$.

At this time, the third proportional factor $\alpha_3$, and the third offset value $\beta_3$ are set by values that can obtain an optimum third on-time. For example, the third offset value $\beta_3$ is set by a value by which the surface temperature T of the fusing roller 111 is maintainable at the sixth target temperature $Tt_6$ when the heater is driven only for an on-time calculated by the formula of $T_5\times\beta_3/100$ every fourth control period $T_5$ after the surface temperature T of the fusing roller 111 has reached the sixth target temperature $Tt_6$, or a value less than the value.

Thereafter, the controller determines whether the third on-time still remains (S4*f*), and drives the heater 112 (S4*g*) or stops the driving of the heater 112 (S4*h*) according to the left third on-time.

Thus, after repeatedly carrying out operations (S4*c*–S4*h*), the controller ends the power saving operation S4 when at operation S4*b*, the print command is input, and again moves to the initial fusing roller-warming-up operation S1 to repeat operations explained above.

Figure 10:
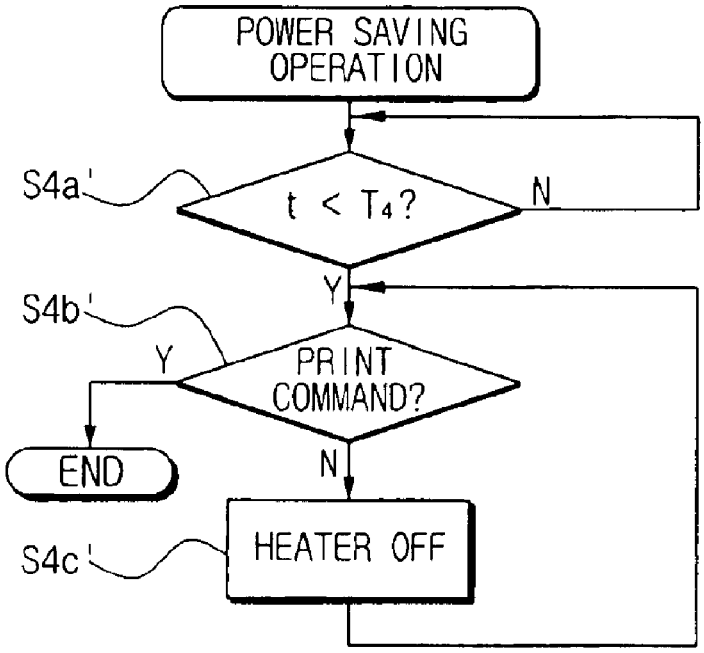
FIG. 10 is a flowchart illustrating another example of a process of the power saving operation of the temperature control method in accordance with an embodiment of the present invention.

Alternatively, as shown in FIG. 10 illustrating another example of the process of the power saving operation S4, the power saving operation S4 is performable by determining whether the standby time $T_4$ has lapsed (S4*a*'), determining whether the print command is input when the standby time $T_4$ has lapsed (S4*b*'), and then stopping the driving of the heater 112 when the print command is not input.

As described so far, it will be appreciated that the temperature control method for use in the fusing device according to the present invention provides an effect that minimizes the fluctuation in the surface temperature of the fusing roller and optimizes the AC power supply to the heater, by controlling the optimum temperature by using the different algorithm for each of operations such as the initial fusing roller-warming-up operation, the print standby operation, the printing operation, and the power saving operation.

Although a few preferred embodiments of the present invention have been shown and described, the present invention is not limited to the disclosed embodiments. Rather, it would be appreciated by those skilled in the art that changes may be made in this embodiment without departing from the principles and spirit of the invention, the scope of which is defined in the claims and their equivalents.

What is claimed is:

1. A temperature control method for use in a fusing device of image forming apparatus having a fusing roller and a heater heating the fusing roller, comprising:

sensing a surface temperature T of the fusing roller at one of when the image forming apparatus is turned on, when the image forming apparatus begins a normal operation from a power saving operation, and when a cover of the image forming apparatus is closed after being opened;

comparing the sensed surface temperature T of the fusing roller with a set temperature;

driving the heater until the surface temperature T reaches a first target temperature $Tt_1$ when the sensed surface temperature T is below the set temperature; and driving the heater until the surface temperature T reaches a second target temperature $Tt_2$ when the sensed surface temperature T is over the set temperature, wherein the first target temperature Tt1 is one of a temperature Tv so that the surface temperature T of the fusing roller is increasable to the third target temperature Tt3 when the heater is turned off after heating the surface temperature T of the fusing roller to the first target temperature Tt1, and a temperature higher than the temperature Tv.

2. The method of claim 1, wherein the driving the heater until the surface temperature T reaches the second target temperature $Tt_2$ includes driving the heater for a first on-time calculated by the following formula every first control period $T_1$, wherein:

$$\text{first on-time (ms)}=T_1\times(\alpha_1\times(T-Tt_2)+\beta_1)/100,$$

and wherein $\alpha_1$ is a first proportional factor and $\beta_1$ is a first offset value set according to the second target temperature $Tt_2$.

3. The method of claim 2, wherein the first proportional factor $\alpha_1$ is determined by the second target temperature $Tt_2$ and a rising slope in the surface temperature T of the fusing roller.

4. The method of claim 2, wherein the first offset value $\beta_1$ is settable by a first value, by which the surface temperature T of the fusing roller is maintainable at the second target temperature $Tt_2$ when the heater is driven only for an on-time calculated by the formula of $T_1\times\beta_1/100$ every first control period $T_1$ after the surface temperature of the fusing roller has reached the second target temperature $Tt_2$, and a second value less than the first value.

5. The method of claim 1, further comprising standing by by controlling the driving of the heater to maintain the surface temperature T at a third target temperature $Tt_3$ after the sensing, comparing and driving operations.

6. The method of claim 5, wherein the standing by includes driving the heater for a second on-time calculated by the following formula every second control period $T_2$ to maintain the surface temperature T at the third target temperature $Tt_3$, wherein:

$$\text{second on-time (ms)}=T_2\times(\alpha_2\times(T-Tt_3)+\beta_2)/100,$$

and wherein $\alpha_2$ is a second given proportional factor and $\beta_2$ is a second offset value set according to the third target temperature $Tt_3$.

7. The method of claim 6, wherein the second proportional factor $\alpha_2$ is determined by the third target temperature $Tt_3$ and a rising slope in the surface temperature T of the fusing roller.

8. The method of claim 6, wherein the second offset value $\beta_2$ is one of a value V by which the surface temperature T of the fusing roller is maintained at the third target temperature $Tt_3$ when the heater is driven only for an on-time calculated by the following formula every second control period $T_2$, and a value less than the value V, wherein:

$$\text{on-time}=T_2\times\beta_2/100.$$

9. The method of claim 1, wherein the second target temperature $Tt_2$ is the same temperature as the third target temperature $Tt_3$, the third target temperature $Tt_3$ being a print standby temperature.

10. The method of claim 2, wherein the first proportional factor $\alpha_1$ is one of the same value as the second proportional factor $\alpha_2$ and a value larger than the value of the second proportional factor $\alpha_2$.

11. The method of claim 5, further comprising printing by controlling the driving of the heater to maintain the surface temperature T at a fifth target temperature $Tt_5$ when a print command is input in the standing by.

12. The method of claim 11, wherein the printing comprises:

driving the heater until the surface temperature T reaches a fourth target temperature $Tt_4$; and controlling the driving of the heater to maintain the surface temperature T at the fifth target temperature $Tt_5$.

13. The method of claim 12, wherein the operation of controlling the driving of the heater to maintain the surface temperature T at the fifth target temperature $Tt_5$ comprises:

driving the heater when a surface temperature T of the fusing roller sensed every third control period $T_3$ is below the fifth target temperature $Tt_5$; and stopping the driving of the heater when the surface temperature T of the fusing roller sensed every third control period $T_3$ is over the fifth target temperature $Tt_5$.

14. The method of claim 13, wherein in the stopping the driving of the heater, when the surface temperature T of the fusing roller is greater than fifth target temperature $Tt_5$, and the heater is driving and a heater driving time has not lapsed, the heater is continuously driven until the heater driving time lapses.

15. The method of claim 14, wherein the fourth target temperature $Tt_4$ is one of the same temperature as the fifth target temperature $Tt_5$ and a temperature higher than the fifth target temperature $Tt_5$.

16. The method of claim 5, further comprising saving power by carrying out a power saving operation when a print command is not input even though a standby time $T_4$ has lapsed in the standing by.

17. The method of claim 16, wherein the power saving comprises:

determining whether the print command is input every fifth control period $T_5$ after a lapse of the standby time $T_4$; and controlling the driving of the heater to maintain the surface temperature T at a sixth target temperature $Tt_6$ when the print command is not input.

18. The method of claim 17, wherein the controlling the driving of the heater to maintain the surface temperature T at the sixth target temperature $Tt_6$ comprises driving the heater for a third on-time calculated by the following formula every fourth control period $T_5$, wherein:

$$\text{third on-time (ms)}=T_5\times(\alpha_3\times(T-Tt_6)+\beta_3)/100,$$

and wherein $\alpha_3$ is a third given proportional factor and $\beta_3$ is a third offset value set according to the sixth target temperature $Tt_6$.

19. The method of claim 18, wherein the sixth target temperature $Tt_6$ is settable by an appropriate temperature below the third target temperature $Tt_3$ that is a print standby temperature.

20. The method of claim 16, wherein the power saving comprises:

determining whether the print command is input after a lapse of the standby time $T_4$; and stopping the driving of the heater when the print command is not input.

21. The method of claim 1, wherein the fusing roller comprises a rubber layer formed in a given thickness on a surface thereof.

22. The method of claim 18, wherein the third offset value $\beta_3$ is settable by one of a first value, by which the surface temperature T of the fusing roller is maintainable at the third target temperature $Tt_3$ when the heater is driven only for an on-time calculated by the formula of $T_5\times\beta_3/100$ every fourth control period $T_5$ after the surface temperature T of the fusing roller has reached the sixth target temperature $Tt_6$, and a second value less than the first value.

23. The method of claim 17, wherein the power saving includes determining whether the print command is input after the lapse of the standby time $T_4$, and stopping the driving of the heater when the print command is not input.

* * * * *

UNITED STATES PATENT AND TRADEMARK OFFICE

CERTIFICATE OF CORRECTION

PATENT NO. : 7,254,352 B2
APPLICATION NO. : 10/732249
DATED : August 7, 2007
INVENTOR(S) : Beom-ro Lee It is certified that error appears in the above-identified patent and that said Letters Patent is hereby corrected as shown below:

Column 12, Line 20, change "Tt1" to --$Tt_1$--.

Column 12, Line 25, change "Tt1," to --$Tt_1$,--.

Column 12, Line 50, before "controlling" delete "by".

Column 13, Line 44, change "14," to --12,--.

Signed and Sealed this

Nineteenth Day of February, 2008

JON W. DUDAS
*Director of the United States Patent and Trademark Office*